US007275491B1

(12) United States Patent
Cook et al.

(10) Patent No.: US 7,275,491 B1
(45) Date of Patent: Oct. 2, 2007

(54) SAIL FURLING SYSTEM WITH RECIRCULATING HALYARD

(75) Inventors: Fred C. Cook, Assonet, MA (US); David R. Dion, Marion, MA (US)

(73) Assignee: Schaeffer Marine, Inc., New Bedford, MA (US)

( * ) Notice: Subject to any disclaimer, the term of this patent is extended or adjusted under 35 U.S.C. 154(b) by 0 days.

(21) Appl. No.: 11/550,232

(22) Filed: Oct. 17, 2006

(51) Int. Cl.
*B63H 9/04* (2006.01)

(52) U.S. Cl. ..... 114/104; 114/108; 114/112

(58) Field of Classification Search ..... 114/39.11, 114/39.21, 104, 105, 106, 107, 108, 112
See application file for complete search history.

(56) References Cited

U.S. PATENT DOCUMENTS 3,851,609 A 12/1974 Stearn
4,248,281 A 2/1981 Hood
4,267,791 A * 5/1981 Ingouf ..... 114/106
4,474,127 A * 10/1984 Stevenson, IV ..... 114/105
4,620,498 A * 11/1986 Clausin ..... 114/106
4,688,506 A * 8/1987 van Breems ..... 114/104
4,821,664 A 4/1989 Dahmen
5,048,443 A * 9/1991 Brown ..... 114/104
5,619,946 A 4/1997 Wallasch
5,890,447 A 4/1999 Bernson
6,173,668 B1 1/2001 Kyle
6,895,882 B1 5/2005 Dahmen

* cited by examiner

*Primary Examiner*—Lars A. Olson
(74) *Attorney, Agent, or Firm*—Mark P. White

(57) ABSTRACT

A sail furler with a recirculating halyard includes a foil having a longitudinal halyard channel and a longitudinal recirculating halyard channel formed within; and a halyard, having a first and second end, the halyard affixed at its first end to a slider, the slider affixed to head of the sail, the halyard rising to an upper end of the foil, leading through a top cap, and then descending downwards through the halyard channel to an exit of the halyard channel in proximity to a lower end of the foil, then ascending through the recirculating halyard channel, and terminating at its second end to the slider, so that the distance between the second halyard end and the head of the sail remains constant whether the sail is raised or lowered.

20 Claims, 11 Drawing Sheets

SAIL FURLING SYSTEM WITH RECIRCULATING HALYARD

FIELD OF THE INVENTION

This invention is directed to the field of marine technology, and more specifically to the field of sail-hoisting devices.

DESCRIPTION RELATIVE TO THE PRIOR ART

Modern yachting has seen dramatic developments in technologies which reduce the drudgery of handling sails in the past several decades. In particular, systems which allow easy furling and reefing of sails have proliferated, allowing a single person to set, reef, furl, and secure sails with a minimum of effort.

An invention for furling foresails was described in U.S. Pat. No. 4,821,664, and may be understood by referring to FIGS. 4 and 11. This invention provides a foil 1 which contains three channels, wherein the forestay 4 of the sailboat is captured by central tunnel 11, as seen in the cross-sectional view of the foil as depicted in FIG. 4. The foil 1 thus rotates freely about the forestay, and is completely supported by said forestay. This configuration is especially advantageous in the case of sailboats which are trailered, because the furler need not be removed when the mast is stepped or unstepped, or rotated on a tabernacle.

Still referring to FIGS. 4 and 11, it may be seen that the sail 2 is raised by pulling down on a handle 38, which is inserted in the forward foil channel 10 and attached within the forward foil channel to the downward portion of the halyard 133. The halyard progresses upward to the prior art foil cap 105, where it is led downward again 33, and finally attaches to the head 28 of the sail.

The luff 1 of the sail 2, has a luff rope or bead formed within, which is captured within the aft sail channel 23 of the foil.

The sail 2 is maintained in tension by the downhaul 54, which is attached to a becket at the clew of the sail 52, and a rope 40 which attaches at one end to the handle 38, and is belayed at the other end at a fitting 42, typically a cleat. Tension on the forestay is adjusted by means of the turnbuckle 50 affixed to the forestay lower end.

Unlike many other prior art furlers, the invention described in the '664 patent does not require support from a separate halyard attached to the mast. Instead, the rigidity of the foil is used to counter the tension on the luff of the foresail. The foil, in turn, is reinforced by the forestay, which prevents the foil from bending or bulging, so that the foil need only resist compression to maintain the sail in its proper setting.

The present invention is an improvement on the configuration just discussed in that the mechanism of the current invention functions more reliably, provides further safety and security features, is less subject to jamming and does away with the perennial problem of losing the tail end of the halyard when it is attached to a separate rope, as described above.

SUMMARY OF THE INVENTION

It is an object of the present invention to provide a staysail furler wherein the halyard is affixed at both ends in proximity to the head of the sail, so that the sailor handling the halyard never handles the bitter end of the halyard.

In accordance with a first aspect of the invention a system for furling a sail includes a foil having a longitudinal halyard channel and a longitudinal recirculating halyard channel formed within the foil.

In accordance with a second aspect of the invention a halyard, having a first and second end, is affixed at its first end in proximity to the head of the sail.

In accordance with a third aspect of the invention, the halyard rises to an upper end of the foil, then descends through the halyard channel to an exit near the lower end of the foil, then ascending through the recirculating halyard channel, and terminates in proximity to the head of the sail.

In accordance with a fourth aspect of the invention the distance between the second halyard end and the head of the sail remains constant whether the sail is raised or lowered.

In accordance with a fifth aspect of the invention a slider is slidingly disposed about the foil, and has an upper and a lower end, and a fore and aft side.

In accordance with a sixth aspect of the invention the head of the sail is affixed at the slider aft side at its lower end, the first end of the halyard is affixed at the slider aft side at its upper end, and the second end of the halyard is affixed at the slider fore side.

In accordance with a seventh aspect of the invention a top cap is slidingly disposed upon the upper end of the foil, and has a first exit hole and a second exit hole, wherein the halyard exits from its attachment in proximity to the head of the sail into the first exit hole, and then descends through the second exit hole into the halyard channel.

In accordance with an eighth aspect of the invention the foil cap has a worm groove formed thereon, the worm groove communicating between the first exit hole and the second exit hole of the foil cap.

In accordance with a ninth aspect of the invention the foil further contains a headstay tunnel which has a lip which prevents the halyard from chafing on a headstay disposed with the headstay tunnel.

In accordance with a tenth aspect of the invention further comprising means for belaying the halyard, disposed upon the foil in proximity to the lower end of the foil, close to the location where the halyard exits the halyard channel.

In accordance with an eleventh aspect of the invention the second end of the halyard is affixed in proximity to the top end of the slider.

In accordance with a twelfth aspect of the invention the second end of the halyard has a de-cored portion and a crimp sleeve affixed to the halyard at the start of the de-cored portion, so that the de-cored portion of the halyard exits from the recirculating halyard channel.

In accordance with a thirteenth aspect of the invention the de-cord portion of the halyard is lead through a slider lead slot, into the slide lead, and is then knotted to affix it to the slider.

In accordance with a fourteenth aspect of the invention the means for belaying the halyard in proximity to the lower end of the foil consists of a cleat, whereby the halyard is led through the eye of the cleat.

BRIEF DESCRIPTION OF THE DRAWINGS

The foregoing and other objects, features and advantages of the invention will be apparent from the following more particular description of a preferred embodiment of the invention, as illustrated in the accompanying drawings. The drawings are not necessarily to scale, emphasis instead being placed upon illustrating the principles of the invention.

DESCRIPTION OF THE PREFERRED EMBODIMENTS

Figure 1:
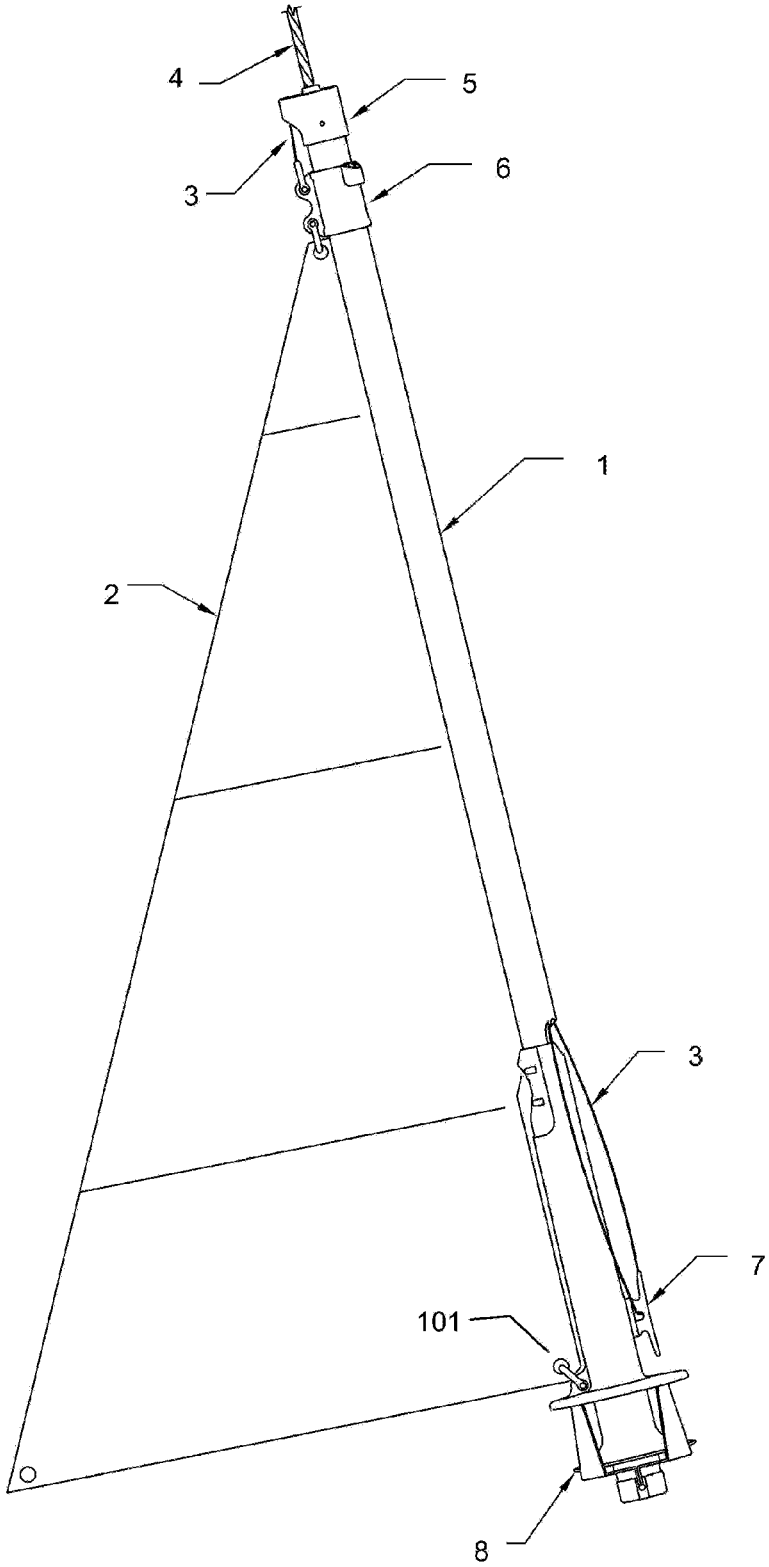
FIG. 1 depicts a side elevation view of a sail hoist on a foil of the present invention.

The preferred embodiment of the present invention may be understood by first referring to FIG. 1, which shows a sail 2 affixed to the aft side of foil 1 at the luff by means of a luff rope or bead 9 which is captured by the luff channel 10. The luff is maintained in tension at its lower end by affixing the tack 101 of the sail to the top of the drum 8. Further, the head of the sail is attached to the lower end of slider 6, which is pulled upward by a first end of halyard 3. The halyard is affixed at its second end to the forward side of slider 6 after threading its way through the halyard channel 23 and the recirculating halyard channel 24.

The halyard forms a loop as it exits the halyard channel near the bottom of the foil, and then enters the recirculating halyard channel. This loop, in turn, is belayed to the cleat 7 which is affixed to the front of the foil.

The presence of the slider 6 in this invention is one of the most obvious distinctions between the present invention and the prior art. The slider, which appears in detail in FIG. 10, has the form of a hollow sleeve which has an inner cross section that mates slidingly with the outside of the foil 1, and therefore moves smoothly up and down on the foil. An upper fitting 27 is affixed to the halyard 3, while the lower fitting 28 is affixed to the head of the sail.

Figure 5:
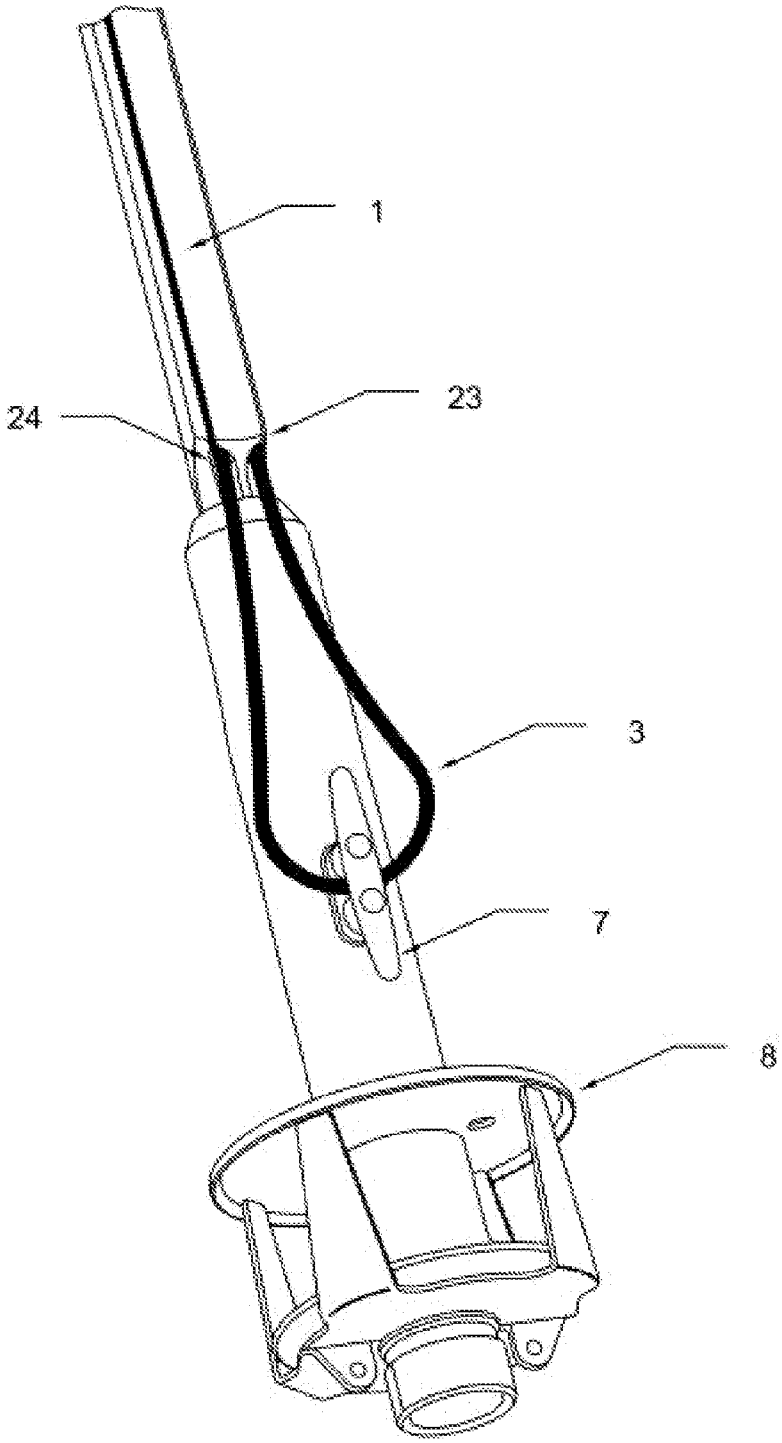
FIG. 5 depicts a perspective view of the bottom of the foil, with the halyard disposed through the eye of the cleat, above the drum of the present invention.
Figure 8:
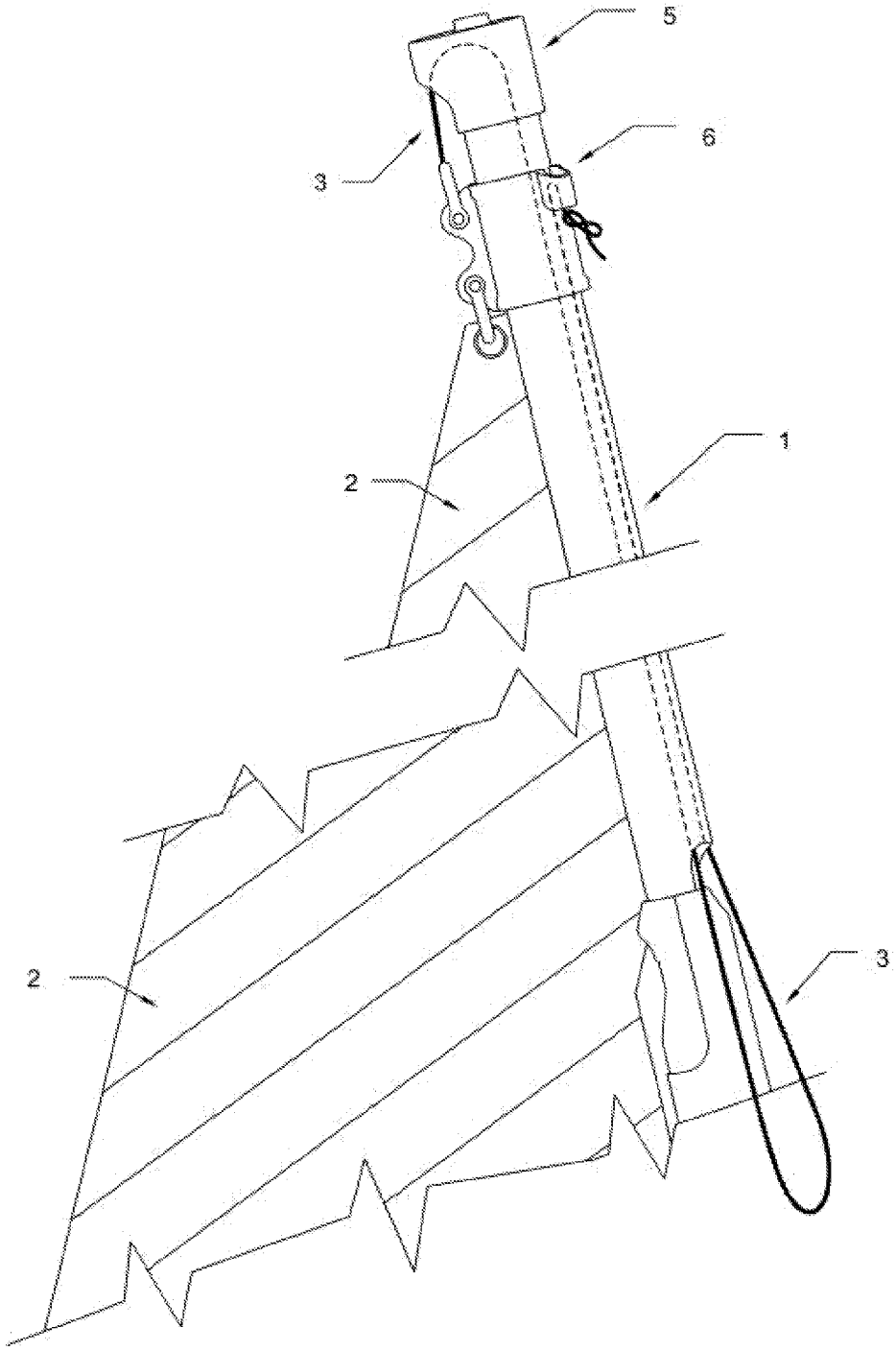
FIG. 8 depicts a perspective view showing the recirculating halyard within the foil of the present invention.

Another major feature of the present invention is the recirculating halyard, which may be understood by referring next to FIGS. 5 and 8. The halyard 3, which is affixed to the upper fitting 27 of the slider 6, is led upward to the head cap 5 atop the foil, and then downward into the halyard channel until it exits 23 at the open bottom of the halyard channel, is routed through the eye of the cleat 7, and then ascends into the bottom of the recirculating halyard channel 24. The halyard continues upward in the recirculating halyard channel 24 until it exits in proximity to the top of the slider, where it is belayed to the fitting at the back of the slider.

Figure 3:
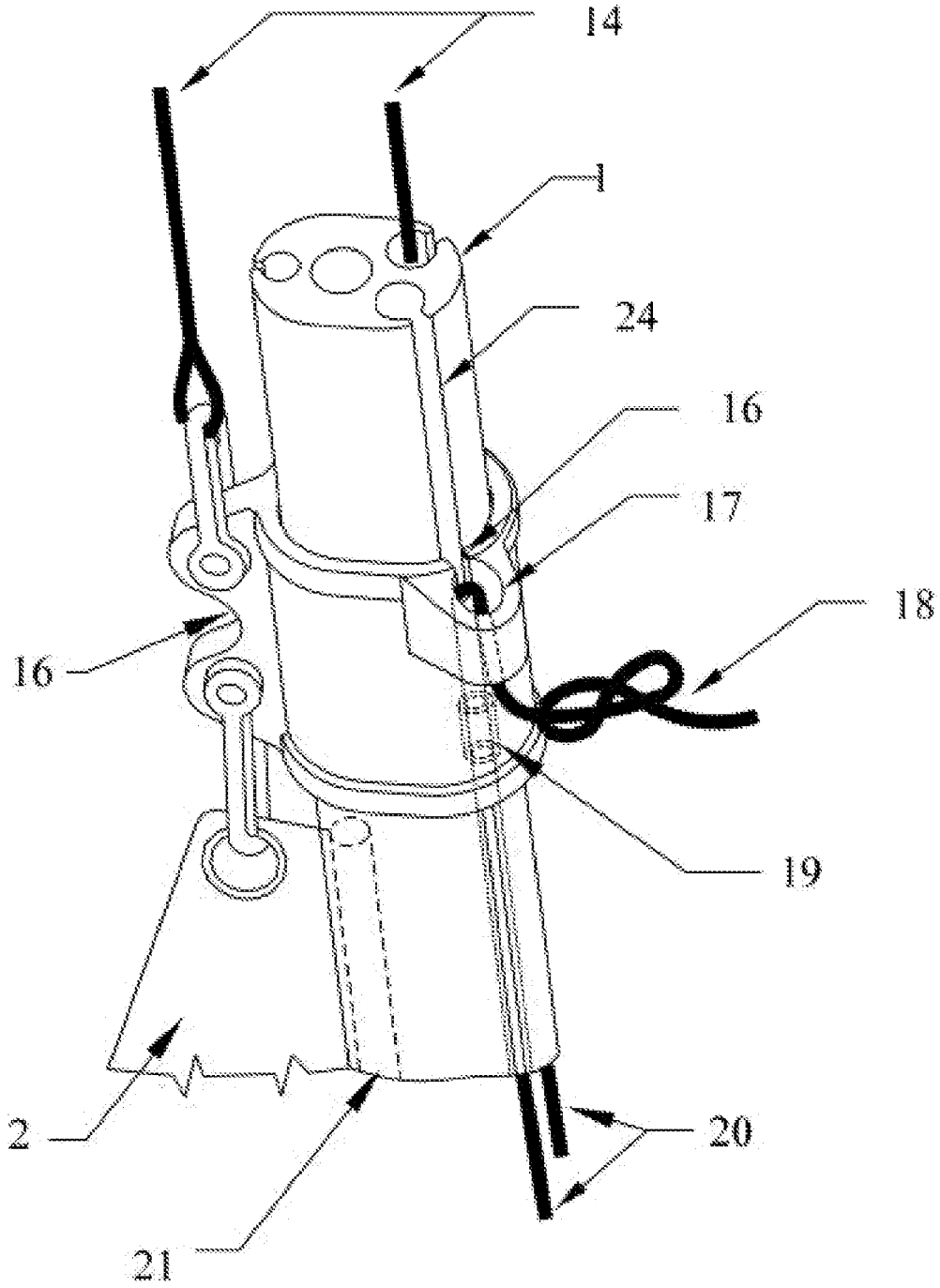
FIG. 3 depicts a perspective view showing detail of the slide, affixed to the foil of the present invention.
Figure 10:
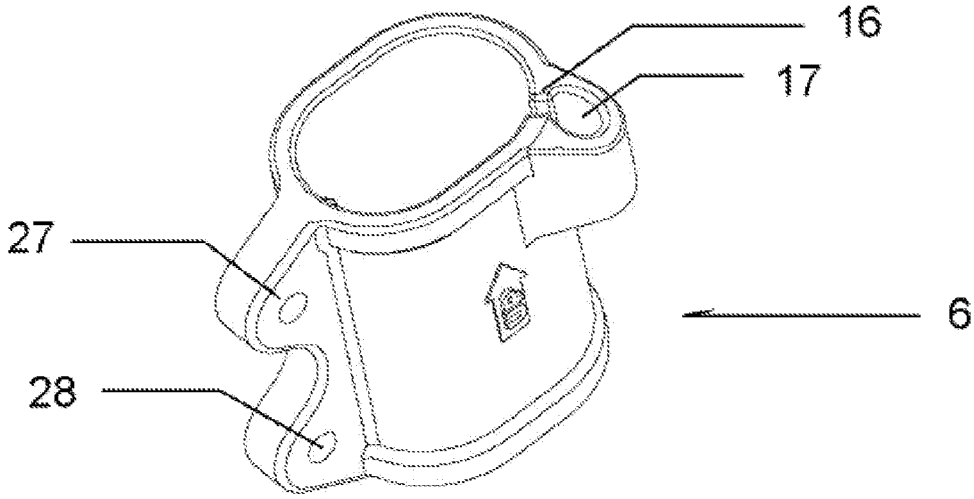
FIG. 10 depicts a perspective view of the slide of the present invention.

Referring next to FIG. 3, the detail at the top of the slider is shown, with the halyards and other rigging shown. The halyard is seen exiting from the slot of the recirculating halyard channel 24, where is enters the slider lead 17 through the slider lead slot 16, as seen in FIG. 10. The halyard dead end is terminated at the bottom of the slider lead 17 by means of a figure eight knot, which keeps the dead end secured at the bottom end of the slider lead.

Figure 6:
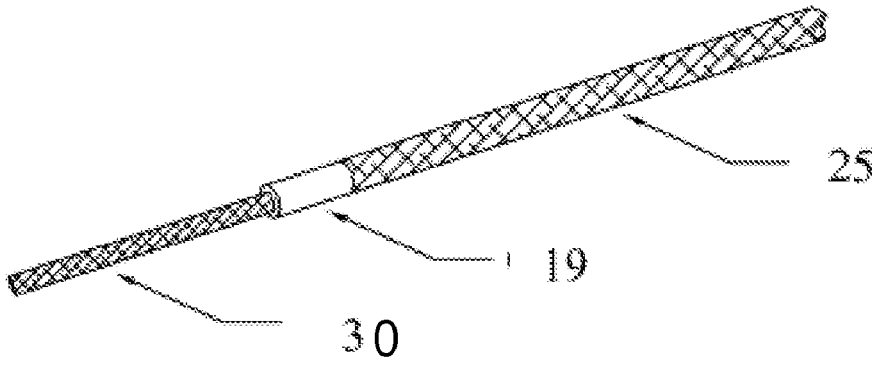
FIG. 6 depicts a perspective view of the tail end of the halyard end of the present invention, with the crimp sleeve affixed and the core-less bitter end shown.

In a typical embodiment of the furler, the dead end of the recirculating portion of the halyard is modified to allow it to exit from the external slot 224 of the recirculating halyard channel 24. A sleeve 19 is crimped onto the tail end of the halyard 30, leaving a short remaining length of rope 30, whose core is removed, so that the diameter of this remaining length is substantially reduced, and so that it may easily exit from the slot of the recirculating halyard channel at the forward side of the foil. It is this de-cored length that is formed into a figure eight knot at the dead end of the halyard which affixes the halyard to the slide. The detail of this modification may be seen by referring to FIG. 6.

The remaining end 30 of the halyard its core removed so that it significantly smaller in diameter than the halyard itself, so that it may exit from the halyard channel 23 of the foil. The crimp sleeve 19 prevents the main body of the halyard from unraveling at the point where the core has been removed, and provides support for the main portion of the halyard 25 at this point. The crimp sleeve 19 may also be seen in the drawing of FIG. 3, as it lies within the recirculating halyard channel 24. This figure also depicts the exit of the coreless portion of the halyard through slider slot 16 at the fore side of the recirculating halyard channel, downward into the slider lead 17, and out through the bottom of the slider lead, where the coreless portion of the halyard is formed into a figure eight knot at the dead end or bitter end of the halyard.

FIG. 3 further shows the halyard 14 attached to the upper fitting 27 at the aft side of the slider by means of a shackle, while a shackle at the lower fitting 26 at the aft side of the slider is affixed to a grommet at the head of the sail 2.

Figure 9:
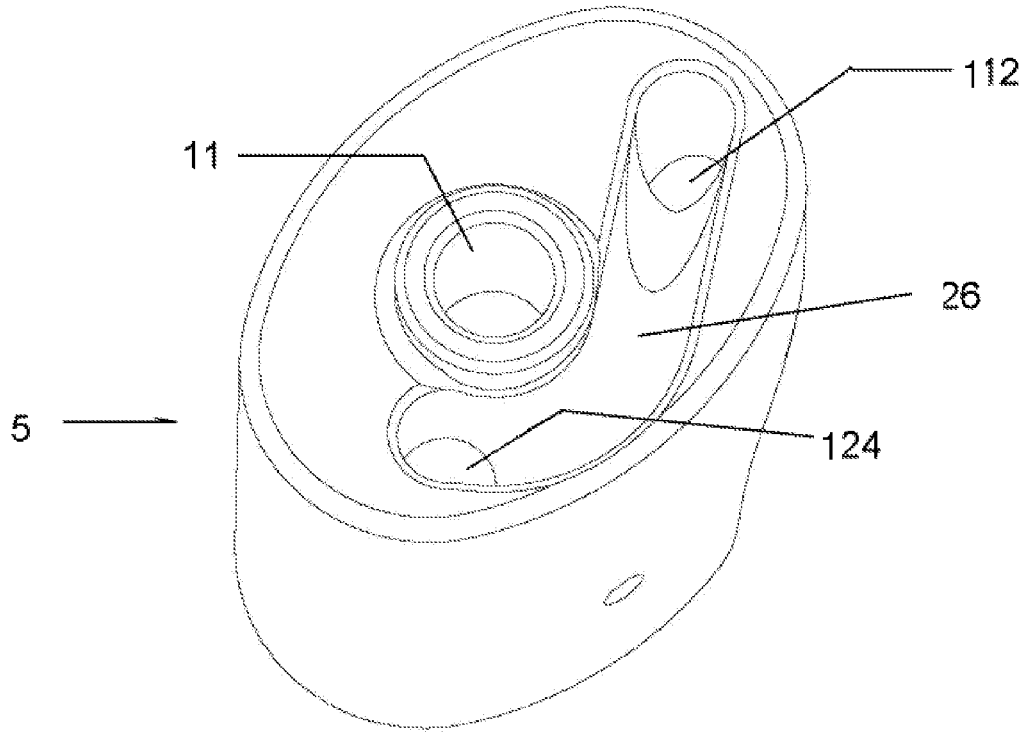
FIG. 9 depicts a perspective view of the top cap of the present invention.

Referring now to FIG. 9 the top cap 5 of the foil is shown. The headstay tunnel 11 extends into the middle of the top cap, where it appears as top cap forestay hole 111, and there is a raised lip formed about this hole extending upwards. The headstay is completely enclosed within the headstay tunnel 11, which provides the main support for the foil, maintaining the foil's position at or near the bow of the sailboat. The foil must be led through this headstay channel before affixing the headstay to the sailboat. This is typically done by leading the lower end of the headstay through the headstay tunnel, and then affixing the lower end of the headstay to the sailboat. In the preferred embodiment of the present invention a drum 8 is formed at the lower end of the foil, so that the headstay also passes through the drum before being affixed at the bow of the sailboat.

The halyard 3 is led upward from its attachment point at the top end of the slider into the first exit hole 112 of the top cap. The halyard then is led downward through the second exit hole 124 into the halyard channel 23. The recessed worm slot 26 formed between the top cap exit holes directs the halyard across the top of the top cap, and around the headstay channel, so that the halyard is not chafed by contact with the stay. The worm slot is formed with contours providing the halyard a smooth transition from the upward path of the halyard from the sail head, across the top of the top cap, and then downward into the halyard channel, so that friction between the halyard and the top cap is minimized.

In alternative embodiments, a pulley or sheave may be used to lead the halyard from the upward portion as it rises from the sail head downward into the channel. Other alternatives are also available for reducing friction and increasing the ease of handling in this regard.

Figure 4:
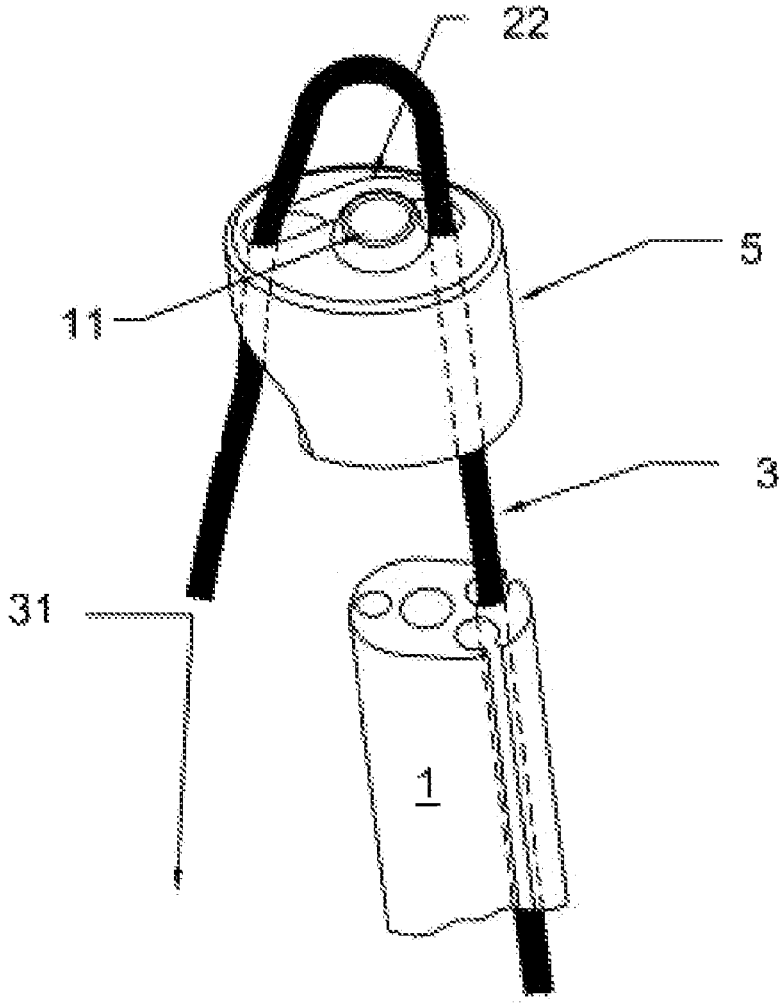
FIG. 4 depicts a perspective view of the top cap above the foil of the present invention.

Referring now to FIG. 4, an exploded view depicts the top cap in relation to the top of the foil. The halyard 3 is seen leading from the head of the sail 31 up into the top cap 5, and then down into the halyard channel 23 of the foil 1.

Figure 2:
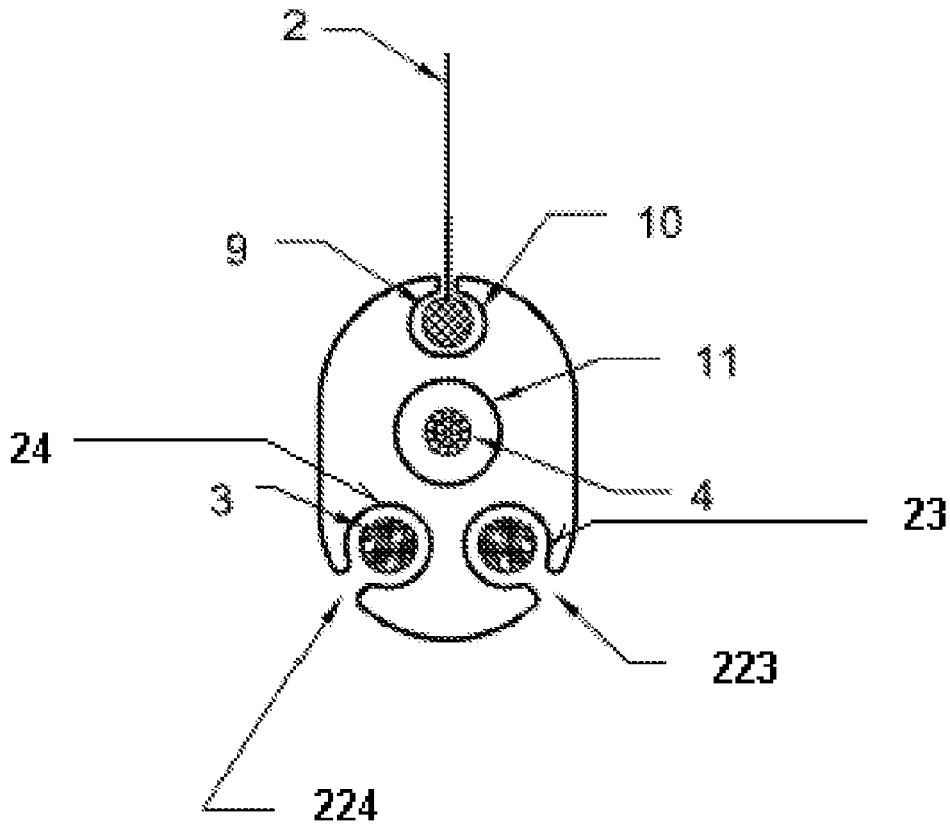
FIG. 2 depicts a cross-sectional view of the foil of the present invention.
Figure 7:
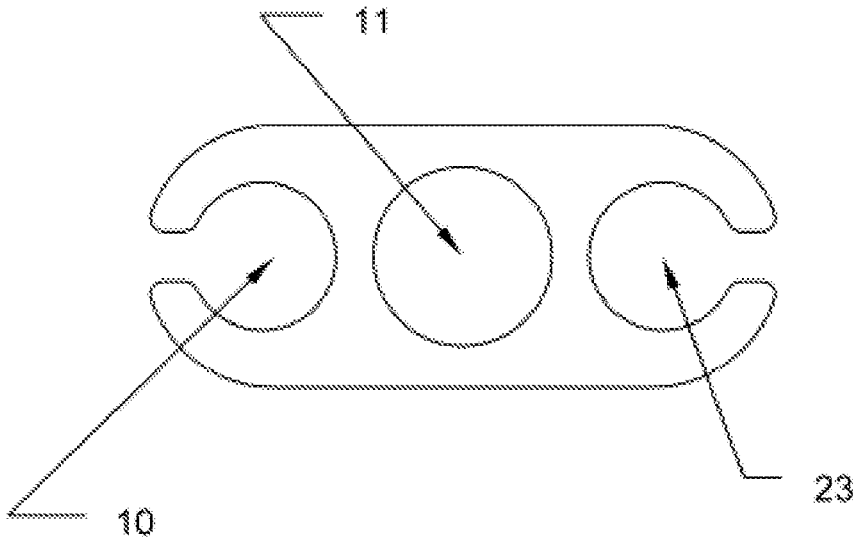
FIG. 7 PRIOR ART
FIG. 7 depicts a cross-sectional view of a prior art foil.
Figure 11:
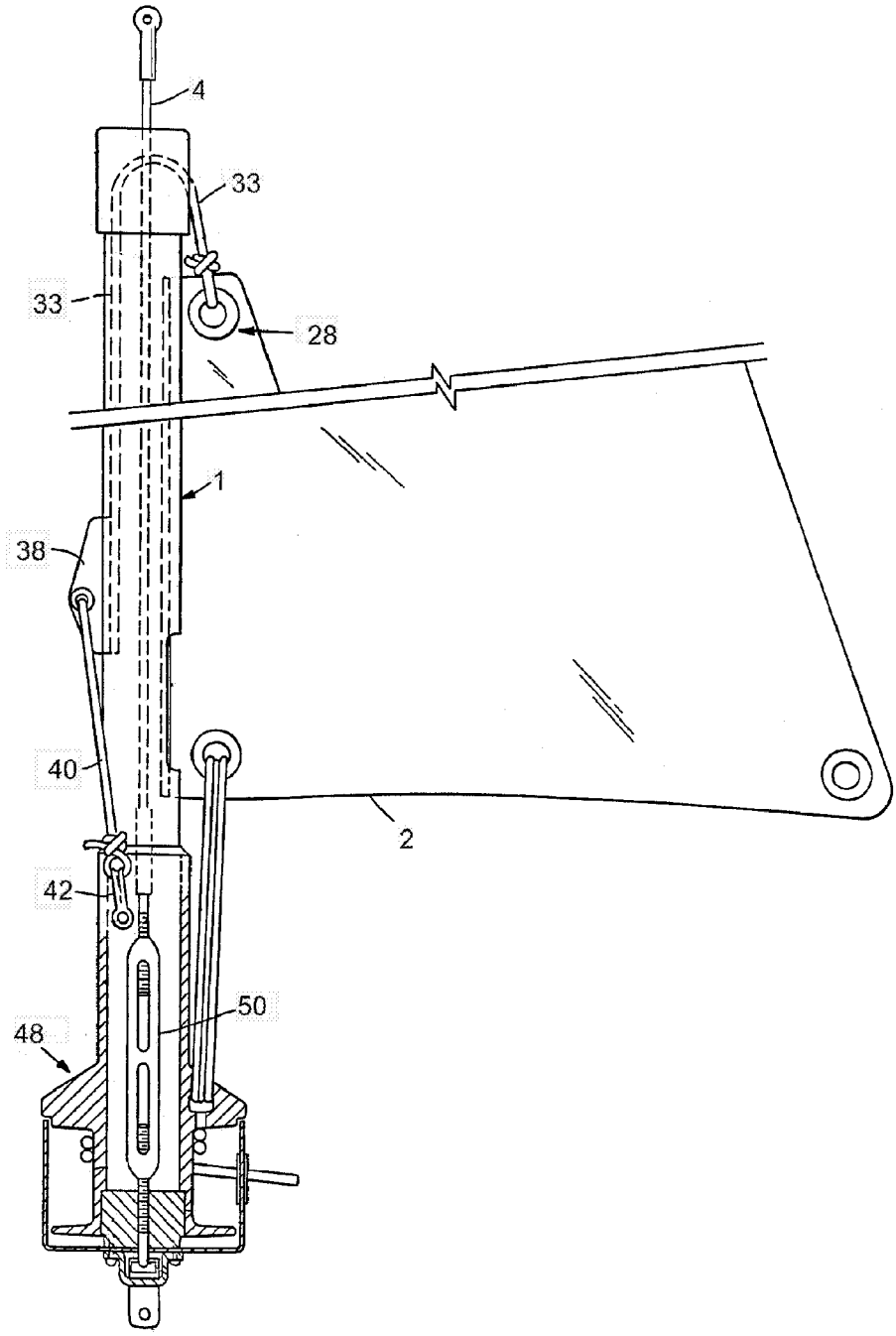
FIG. 11 PRIOR ART
FIG. 11 depicts a cross-section view of a prior art furling system.

The differences between the present invention and the prior art furler depicted in FIG. 11 also include the cross-sectional shape of the foil. The foil of the present invention, as seen in FIG. 2, has an elliptical shape, with the major and minor axes having a ratio of about 1.5 to 1. The prior art foil as seen in FIG. 7, on the other hand, has a ration of about 3 to 1 between the major and minor axes.

Still referring to FIG. 2, it can be seen that the headstay 4 of the sailboat is led through the headstay tunnel 11, which is sufficiently larger than the headstay so that the foil may rotate freely, depending, of course on other external factors, such as sheet and downhaul, to limit the rotation. The bead or luff rope 9 of the sail 2 is contained within the luff channel 10. The two halyard channels 12, 13 contain the halyard 3. Each of the halyard channels contain slots 212, 213, which open outward from the halyard channels. The recirculating halyard terminates in a de-cored tail 30 which exits from the side of the recirculating halyard channel 24 through slot 214, as shown if FIG. 3.

When attempting to furl the prior art furler of FIG. 11, the sail wraps somewhat unevenly about the foil, because of the difference in mechanical advantage when the sail first contacts the long axis of the foil, as opposed to contacting the short axis. The present invention has a foil more nearly round in cross section, and provides a more even pressure of furling as the foil rotates.

The present invention further eliminates the worry of losing the handle by having it slide up to the top of the foil if it unties from the belaying rope of the prior art furler of the '664 patent. Because the halyard of the present invention is continuous, there are no loose ends which untie.

Furthermore, the use of the slider in the present invention provides further reliability and smoothness of operation. Because the tension on the hoisting 27 and sail attachment points 28 of the slider are equal and opposite, there is no net vertical twisting force on the slider, so that it moves up and down the foil without jamming. Furthermore the force on the head of the sail is always parallel to the foil in the present invention, due to the use of the slider. The present system thus provides unparalleled ease of operation and reliability not available in the prior art.

While certain embodiments and examples have been used to describe the present invention, many variations are possible and are within the spirit and scope of the invention. Such variations will be apparent to those skilled in the art upon inspection of the specification and claims herein. Other embodiments are within the following claims.

The invention claimed is:

1. A system for furling a sail comprising:

(a) a foil having a longitudinal halyard channel and a longitudinal recirculating halyard channel formed within; and (b) a halyard, having a first and second end, the halyard affixed at its first end in proximity to a head of the sail, said halyard rising to an upper end of the foil, then descending downwards through the halyard channel to an exit of the halyard channel in proximity to a lower end of the foil, then ascending through the recirculating halyard channel, and terminating at its second end in proximity to the head of the sail, whereby the distance between the second halyard end and the head of the sail remains constant whether the sail is raised or lowered.

2. The system of claim 1, further comprising a slider having an upper and a lower end, and a fore and aft side, the slider enclosing the foil and sliding vertically thereupon, the head of the sail being affixed to the slider aft side at its lower end, a first end of the halyard being affixed to the slider aft side at its upper end, and the second end of the halyard being affixed to the slider fore side.

3. The system of claim 2, further comprising a foil cap slidingly disposed upon the upper end of the foil, the foil cap comprising a first exit hole and a second exit hole, the halyard being led from the aft side of the slider upwards through the first exit hole, and then descending through the second exit hole into the halyard channel.

4. The system of claim 3, wherein the foil cap has a worm groove formed thereon, the worm groove communicating between the first exit hole and the second exit hole of the foil cap.

5. The system of claim 4, the foil further comprising a stay tunnel, the stay tunnel comprising a lip which prevents the halyard from chafing on a stay disposed with the stay tunnel.

6. The system of claim 5, further comprising means for belaying the halyard, said belaying means disposed upon the foil in proximity to the lower end of the foil, proximate to the location where the halyard exits the halyard channel and then enters the recirculating halyard channel, the halyard forming a loop thereby.

7. The system of claim 6, wherein the second end of the halyard is affixed in proximity to the top end of the slider.

8. The system of claim 7, wherein the second end of the halyard further comprises a de-cored portion, and further comprising a crimp sleeve affixed to the halyard at the start of the de-cored portion, and wherein the de-cored portion of the halyard exits from the recirculating halyard channel.

9. The system of claim 8, wherein the de-cored portion of the halyard is led through a slider lead slot, into the slide lead, and is then knotted to affix it to the slider.

10. The system of claim 9, wherein the means for belaying the halyard in proximity to the lower end of the foil further comprises a cleat, and wherein the halyard is led through the eye of the cleat.

11. The system of claim 10, wherein the foil has a cross section in the form of an ellipse comprising a major and a minor axis, and wherein the major axis is not less than 1.5 times the minor axis.

12. The system of claim 11, wherein the sail is a headsail, and the stay is a headstay.

13. The system of claim 2, further comprising a sheave disposed at the top of the foil, the halyard being led from the aft side of the slider upwards and around the sheave, and then descending into the halyard channel.

14. The system of claim 13, the foil further comprising a stay tunnel, the stay tunnel comprising a lip which prevents the halyard from chafing on a stay disposed with the stay tunnel.

15. The system of claim 14, further comprising means for belaying the halyard, said belaying means disposed upon the foil in proximity to the lower end of the foil, proximate to the location where the halyard exits the halyard channel and then enters the recirculating halyard channel, the halyard forming a loop thereby.

16. The system of claim 15, wherein the second end of the halyard is affixed in proximity to the top end of the slider.

17. The system of claim 16, wherein the second end of the halyard further comprises a de-cored portion, and further comprising a crimp sleeve affixed to the halyard at the start of the de-cored portion, and wherein the de-cored portion of the halyard exits from the recirculating halyard channel.

18. The system of claim 17, wherein the de-cored portion of the halyard is led through a slider lead slot, into the slide lead, and is then knotted to affix it to the slider.

19. The system of claim 18, wherein the means for belaying the halyard in proximity to the lower end of the foil further comprises a cleat, and wherein the halyard is led through the eye of the cleat.

20. The system of claim 19, wherein the foil has a cross section in the form of an ellipse comprising a major and a minor axis, and wherein the major axis is not less than 1.5 times the minor axis.

* * * * *